US006940500B2

(12) United States Patent
Washio et al.

(10) Patent No.: US 6,940,500 B2
(45) Date of Patent: Sep. 6, 2005

(54) IMAGE DISPLAY DEVICE AND DISPLAY DRIVING METHOD

(75) Inventors: Hajime Washio, Sakurai (JP); Yasuyoshi Kaise, Tenri (JP); Kazuhiro Maeda, Nara (JP); Yasushi Kubota, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 259 days.

(21) Appl. No.: 10/252,497

(22) Filed: Sep. 23, 2002

(65) Prior Publication Data

US 2003/0058232 A1 Mar. 27, 2003

(30) Foreign Application Priority Data

Sep. 25, 2001 (JP) ..... 2001-292262
Jul. 11, 2002 (JP) ..... 2002-202978

(51) Int. Cl.[7] ..... G09G 5/00

(52) U.S. Cl. ..... 345/204; 345/208; 345/209; 345/211

(58) Field of Search ..... 345/204, 32, 84, 345/90, 151, 94, 96, 209, 88, 87, 211, 208, 98; 348/790, 749; 340/701–705; 359/69–72, 40

(56) References Cited

U.S. PATENT DOCUMENTS 5,300,942 A * 4/1994 Dolgoff ..... 345/32
6,040,814 A * 3/2000 Murakami et al. ..... 345/94
6,563,482 B1 * 5/2003 Yamazaki et al. ..... 345/87
6,784,863 B2 * 8/2004 Yanagi et al. ..... 345/96
2001/0010511 A1 8/2001 Uchino et al.
2002/0036636 A1 * 3/2002 Yangagi et al. ..... 345/211
2002/0180673 A1 * 12/2002 Tsuda et al. ..... 345/87

FOREIGN PATENT DOCUMENTS

JP 05-313606 11/1993
JP 06-337657 12/1994
JP 09-033891 2/1997
JP 2000-162577 6/2000
JP 2001-202066 7/2001

OTHER PUBLICATIONS

U.S. Appl. No. 09/711,009, filed Nov. 9, 2000, Washio et al.

* cited by examiner

*Primary Examiner*—Vijay Shankar
*Assistant Examiner*—Prabodh Dharia
(74) *Attorney, Agent, or Firm*—David G. Conlin; Steven M. Jensen; Edwards & Angell, LLP

(57) ABSTRACT

A potential of a data signal line S during a scanning period is charged to a substantially intermediate potential of a data signal at a corresponding frame. Thus, extremely large dispersion does not occur in a potential of each pixel capacitor with respect to a potential of the data signal line S, so that it is possible to restrict dispersion of a leak current flowing via an active element of each pixel. Thus, potential variation of a pixel PIX is reduced, so that it is possible to improve display quality during a non-scanning period. That is, in an active-matrix-type liquid crystal display, when a frame frequency is reduced by setting the non-scanning period to be sufficiently larger than a scanning period while a standby image is being displayed so as to realize low power consumption, the display quality is improved.

9 Claims, 13 Drawing Sheets

IMAGE DISPLAY DEVICE AND DISPLAY DRIVING METHOD

FIELD OF THE INVENTION

The present invention relates to (a) an active-matrix-type image display device, preferably realized as a liquid crystal display and the like, that includes an electro-optical element and a corresponding pair of an active element and a pixel capacitor, which are provided in each area sectored by a plurality of scanning lines and a plurality of data signal lines intersecting with each other and (b) a driving method thereof. The present invention particularly relates to an image display device and a display driving method thereof arranged so that: a frame frequency is decreased by setting a non-scanning period to be sufficiently longer than a scanning period while a standby image is being displayed, so that low power consumption is realized.

BACKGROUND OF THE INVENTION

FIG. 8 shows a typical active-matrix-type image display device in prior art, and gives illustration as a block diagram showing an electric structure of a liquid crystal display device 1. The liquid crystal display device 1 schematically includes: a display section 2; a scanning signal line driving circuit gd; a data signal line driving circuit sd; and a control signal generating circuit ctl. In the display section 2, as described above, there is provided a pixel PIX at each area sectored by a plurality of scanning signal lines g1, g2, . . . , gm (hereinbelow shown by a reference sign g when they are collectively referred) and data signal lines s1, s2, . . . , sn (hereinbelow shown by a reference sign s when they are collectively referred).

As shown in FIG. 9, the pixel PIX includes: an active element SW and a pixel capacitor Cp. When the scanning signal line g is selected, the active element SW leads an image signal DAT of the data signal line s to the pixel capacitor Cp, so as to maintain the display state while holding the image signal DAT also during the non-scanning period. The pixel capacitor Cp is constituted of a liquid crystal capacitor CL and an auxiliary capacitor Cs.

The data signal driving circuit sd is constituted of a shift resistor 3 and a sampling circuit 4. In the data signal driving circuit sd, the shift resistor 3 performs sampling with respect to the image signal DAT that has been inputted to an analog switch of the sampling circuit 4 in synchronism with timing signals such as (a) a clock signal CKS from the control signal generating circuit ctl, (b) an inversion signal CKSB corresponding to CKS, and (c) a data scanning start signal SPS, so as to write the image signal DAT that has been subjected to the sampling in the respective data signal lines s as required.

The scanning signal line driving circuit gd is constituted of a shift resistor 5, and selects the scanning signal line g sequentially in synchronism with the timing signals such as (a) a clock signal CKG from the control signal generating circuit ctl and (b) a scanning start signal SPG, so as to control ON/OFF of the active element SW disposed in the pixel PIX. When the active element SW is ON, the image signal DAT in the data signal line s is written in the pixel PIX so as to be held by the pixel capacitor Cp disposed in the pixel PIX as described above. The operation described above is repeatedly performed, so that it is possible to display images on the display section 2.

FIG. 10 is a wave form chart showing an example of a drive wave form of the foregoing writing operation. In this example, a horizontal-line-inversion-type driving method is employed. The image signal DAT is outputted from the control signal generating circuit ctl and is inputted to the data signal line driving circuit sd, in synchronism with the clock signals CKS, CKSB, and the data scanning start signal SPS. In response to the clock signals CKS, CKSB, and the data scanning start signal SPS, selective pulses are sequentially outputted to odd-numbered scanning signal lines (g1, g3, . . . ) and even-numbered scanning signal lines (g2, g4, . . . ), and the image signals DAT are sequentially written in the pixels of the respective data signal lines s1 (s1, s2, . . . ). In this example, image signals of positive polarity are written in the pixels of the odd-numbered scanning signal lines (g1, g3, . . . ), and image signals of negative polarity are written in the pixels of the even-numbered scanning lines (g2, g4, . . . ).

Incidentally, realization of low power consumption in an image display device is more and more desired recently. As one measures for satisfying the desire, there is provided a low-frame-frequency driving method in which a non-scanning period is set to be sufficiently longer than a scanning period so as to realize low power consumption in a case where a static image or a time-varying image of a low refresh rate is displayed while a standby image is being displayed. In the low frame frequency driving method, an image is written in the pixel PIX at one frame as described above, and scanning is stopped for several (2 to 8) frames, so that the non-scanning period is set to be sufficiently longer than the scanning period. FIG. 11 shows how the data signal line driving circuit sd is operated in accordance with the low-frame-frequency driving method.

During the scanning period, the selective pulses are sequentially derived to the scanning signal lines g1, g2, . . . . Corresponding to this, the image signal DAT whose polarity is inverted at each horizontal scanning period in accordance with the horizontal-line-inversion-type driving method is inputted from the control signal generating circuit ctl, and a level corresponding to an i-numbered data signal line si is outputted to an arbitrary data signal line si by the sampling circuit 4. A level of the data signal line si at a timing when the selective pulse drops is written in the respective pixels PIX1, PIX2, . . . , so as to be held over the non-scanning period at more than one frame period described above.

Here, as shown in FIG. 12, as to the pixels PIX1 and PIX2 corresponding to the arbitrary data signal line si and the scanning signal lines g1 and g2, the following operation is performed: in a case where the low frame frequency drive is performed, electric charges held in the pixel capacitors Cp of the pixels PIX1 and PIX2 during the scanning period are separated from the data signal line si by the active element SW after the scanning period. However, a voltage VDS is actually applied to a line between a source and a drain of the active element SW. Further, capacitance of the data signal line si is much larger than that of the pixel capacitor Cp.

Thus, if the data signal line si is left at a potential in finishing the scanning after the scanning period, there occurs such problem that: as the source/drain voltage VDS, that is, a difference between a potential of the pixel capacitor Cp and a potential of the data signal line si is larger, a leak current occurs, so that the electric charge held in the pixel capacitor Cp may leak. In order to solve the problem, a method for minimizing influence exerted on the display state by the leak current is employed, for example, the auxiliary capacitance is made larger.

However, the leak current varies according to the source/drain voltage VDS as described above, and it is typical that different charges (potentials) are held in the respective pixels PIX according to display images, so that the source/drain voltage VDS varies for the respective pixels PIX. In this manner, the leak current varies for the respective pixels PIX, so that the display quality may be deteriorated.

Particularly in a liquid crystal display, ac drive is required. Thus, in the horizontal line inversion drive type for example, electric charges different in polarity such as positive and negative are held in upper and lower pixels adjacent to each other. Thus, as shown in FIG. 13, in a case where, for example, a charging potential of the data signal line si is negative when the scanning period comes to an end so as to shift to the non-scanning period, the source/drain voltage VDS2 is small in the pixel PIX2 holding a negative charge. On the other hand, the source/drain voltage VDS1 is large in the pixel PIX1 holding a positive charge, and a leak current is larger, so that there occurs such problem that: display concentration of the pixel having the positive charge in the non-scanning period fades away (in a case of normally white).

SUMMARY OF THE INVENTION

The object of the present invention is to provide an image display device and a display driving method both of which bring about such an advantage that: display quality during the non-scanning period can be improved even though a frame frequency is reduced while a standby image is being displayed so as to realize low power consumption.

The image display device of the present invention includes an electro-optic element, and a corresponding pair of an active element and a pixel capacitor, which are provided at an area sectored by a plurality of scanning lines and a plurality of data signal lines intersecting with each other, and the electro-optic element is driven to create a display in accordance with an electric charge that has been taken in the pixel capacitor by means of the active element during a scanning period of the scanning signal line, wherein the image display device further includes charging means for charging the data signal line to a substantially intermediate potential of a data signal at a frame corresponding to a non-scanning period of the scanning signal line during the non-scanning period.

According to the arrangement, an active-matrix-type image display device is such that: an active element is provided at an intersection of a plurality of scanning lines and a plurality of data signal lines intersecting with each other, and a data signal is taken in a pixel capacitor by means of the active element during a scanning period of the scanning signal line, and an electric charge of the data signal that has been taken in the pixel capacitor drives an electro-optic element to create a display, so that the display is maintained also during a non-scanning period of the scanning signal line, wherein the charging means charges a potential of the data signal during the non-scanning period to a substantially intermediate potential of the data signal line during the scanning period of a corresponding frame. After completing the charge, at least right before the next scanning period begins, the charging means becomes high impedance, so that the data signal line is under the floating condition.

Thus, in a case where the potential of the data signal line in the non-scanning period is left at the maximum potential or the minimum potential of the data signal in the scanning period for example, extremely large dispersion may occur between the potential of the data signal line and the potential of the pixel capacitors depending on the potential of the pixel capacitors. On the other hand, by setting the potential of the data signal line to be the substantially intermediate potential of the data signal, the extremely large dispersion does not occur in the potential of the pixel capacitors with respect to the potential of the data signal line, so that it is possible to restrict dispersion of a leak current flowing via the active element. Thus, even though a frame frequency is decreased by setting the non-scanning period to be sufficiently longer than the scanning period while a standby image etc. is being displayed, so as to realize low power consumption, it is possible to reduce potential variation of the pixel, thus improving the display quality during the non-scanning period.

Further, the image display device of the present invention includes an electro-optic element, and a corresponding pair of an active element and a pixel capacitor, which are provided at an area sectored by a plurality of scanning lines and a plurality of data signal lines intersecting with each other, and the electro-optic element is driven to create a display in accordance with an electric charge that has been taken in the pixel capacitor by means of the active element during a scanning period of the scanning signal line, wherein the image display device includes potential varying means for varying a potential of the data signal line during a non-scanning period of the scanning signal line.

According to the arrangement, an active-matrix-type image display device is arranged so that: an active element is provided at an intersection of a plurality of scanning lines and a plurality of data signal lines intersecting with each other, and a data signal is taken in a pixel capacitor by means of the active element during a scanning period of the scanning signal line, and an electric charge of the data signal that has been taken in the pixel capacitor drives an electro-optic element to create a display, so that the display is maintained also during a non-scanning period of the scanning signal line, wherein the potential varying means varies a potential of the data signal in the non-scanning period. At least right before the next scanning period begins, the potential varying means becomes high impedance, so that the data signal line is under the floating condition.

Thus, in a case where the potential of the data signal line is fixed for example, extremely large dispersion may occur between the potential of the data signal line and the potential of the pixel capacitors depending on the potential of the pixel capacitors. On the other hand, the potential of the data signal line is varied, preferably a periphery of an intermediate potential is swept, so that the extremely large dispersion does not occur in the potential of the pixel capacitors with respect to the potential of the data signal line, and it is possible to restrict the dispersion of a leak current flowing via the active element. Thus, even though a frame frequency is decreased by setting the non-scanning period to be sufficiently longer than the scanning period while a standby image etc. is being displayed so as to realize low power consumption, it is possible to reduce potential variation of the pixel, thus improving the display quality during the non-scanning period.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described as follows based on drawings.

Figure 1:
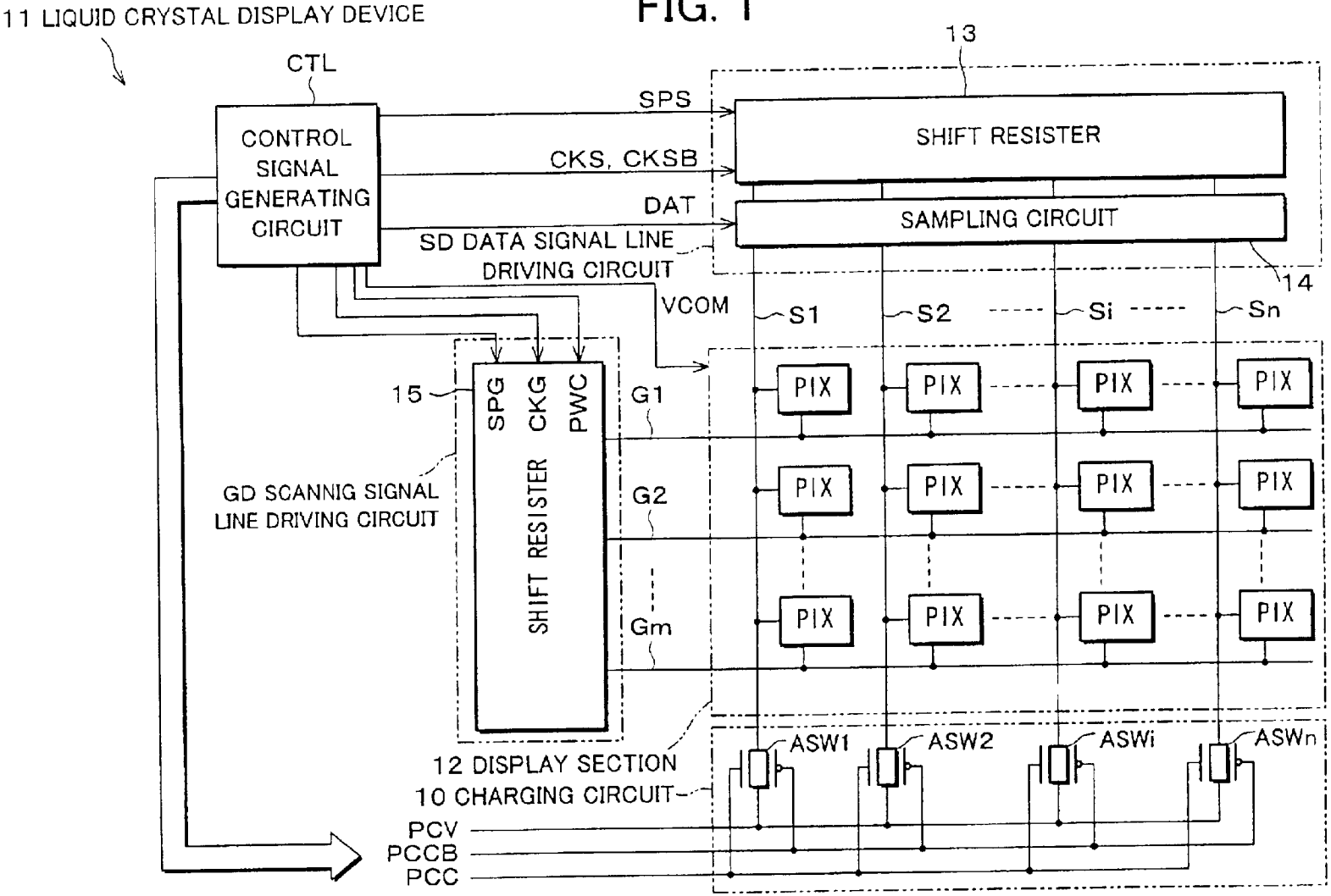
FIG. 1 is a block diagram showing an electric structure of a liquid crystal display which is an image display device of one embodiment of the present invention.

FIG. 1 is a block diagram showing an electric structure of a liquid crystal display device 11 which is an image display device of one embodiment of the present invention. The liquid crystal display device 11 is an active-matrix-type liquid crystal display device, and schematically includes: a display section 12; a scanning signal line driving circuit GD; a data signal line driving circuit SD; a charging circuit 10; and a control signal generating circuit CTL. The data signal line driving circuit SD is constituted of a shift resistor 13 and a sampling circuit 14, and the scanning signal line driving circuit GD is constituted of a shift resistor 15. The data signal line driving circuit SD and the scanning signal line driving circuit GD are arranged as in the data signal line driving circuit sd and the scanning signal line driving circuit gd in the aforementioned liquid crystal display device 1, so that description thereof is omitted.

Further, in the display section 12, as described above, there is provided a pixel PIX at an area sectored by scanning signal lines G1, G2, . . . , Gm (hereinbelow shown by reference sign G when they are collectively referred) and data signal lines S1, S2, . . . , Sn (hereinbelow shown by reference sign S when they are collectively referred) in a matrix manner. Further, the liquid crystal display device 11 of the present invention is same as the liquid crystal display device 1 in that the data signal line S is connected to the data signal line driving circuit SD, but the present invention is arranged so that the charging circuit 10 is further provided in relation to the data signal line S. According to an example shown in FIG. 1, the data signal line driving circuit SD is provided on one end of the data signal line S, and the charging circuit 10 is provided on the other end. Also in a case where these circuits are provided on the same side of the display section 12, it is possible to obtain the same effect.

Also the control signal generating circuit CTL outputs the signals CKS, CKSB, SPS, DAT, CKG, SPG as in the aforementioned control signal generating circuit ctl, and further outputs control signals PCC, PCCB (inversion signal of PCC) and a charging potential PCV, described later, for the charging circuit 10. Each of the pixels PIX is arranged in the same manner as in the pixel PIX shown in FIG. 6.

The charging circuit 10 is arranged so that: there are provided analog switches ASW1 to ASWn, each of which is constituted of a pair of a P-type switching element and an N-type switching element, on the respective data signal lines S, so as to be able to output a charging potential PCV having both positive and negative polarities. The control signals PCC, PCCB are inputted to the analog switches ASW1 to ASWn, so that the charging potential PCV is outputted to the respective data signal lines S.

Figure 2:
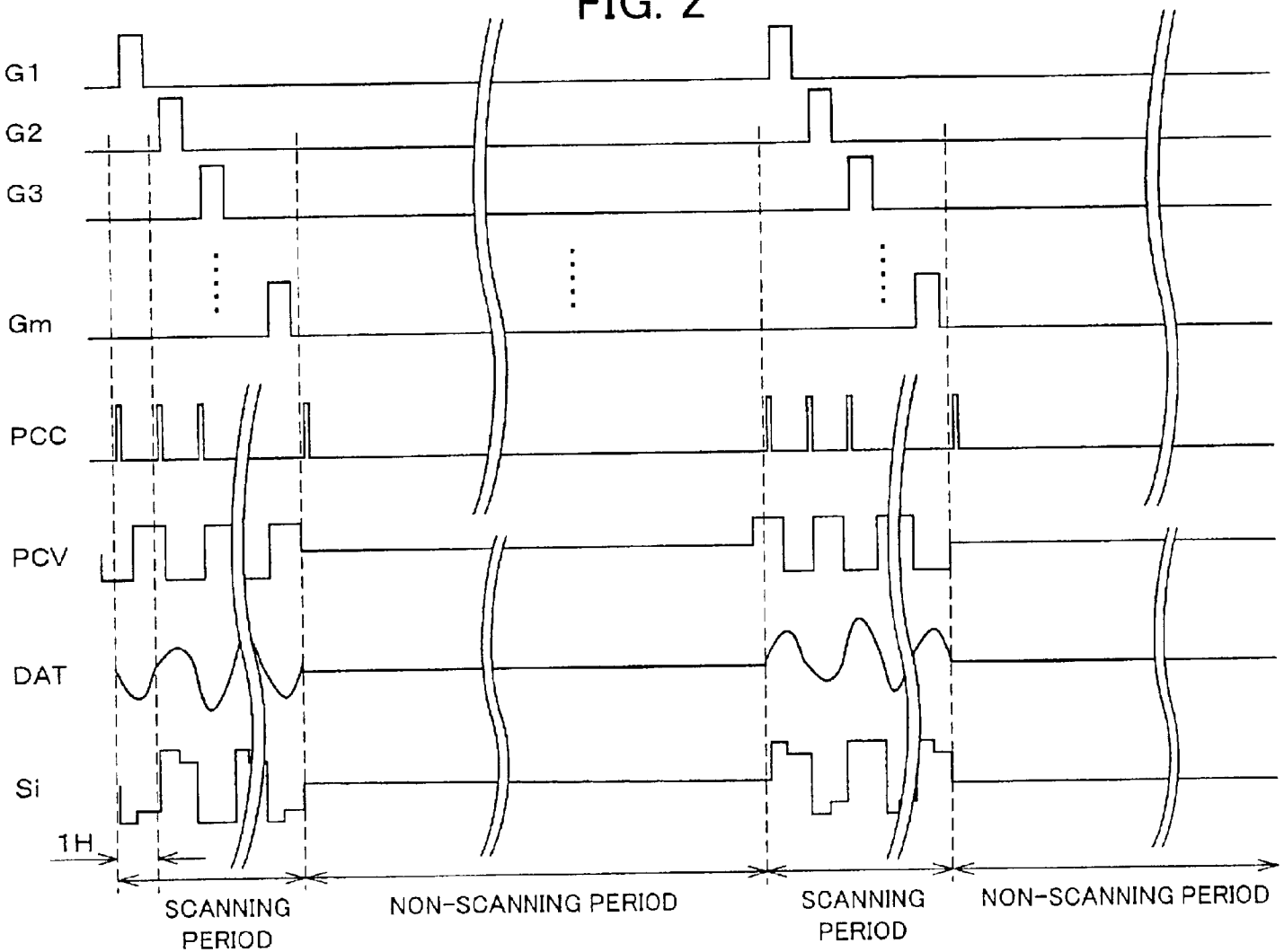
FIG. 2 is a wave form chart showing an example of a drive wave form of the liquid crystal display.

FIG. 2 is a wave form chart showing an example of a drive wave form of the liquid crystal display device 11 arranged in the foregoing manner. In this example, a horizontal-line-inversion-system driving method is employed. During the scanning period, the selective pulses are sequentially derived to the scanning signal lines G1, G2, . . . . Corresponding to this, the image signal DAT whose polarity is inverted in accordance with the horizontal-line-inversion-system driving method at each horizontal scanning period is inputted from the control signal generating circuit CTL, and a level corresponding to an i-numbered data signal line Si is outputted to an arbitrary data signal line Si by the sampling circuit 14. A level of the data signal line Si is written in the pixel capacitor Cp of the pixel PIX, so as to be held over the non-scanning period more than one frame period described above as in the prior art.

It is noteworthy that, in the present invention, the control signal generating circuit CTL varies the control signals PCC and PCCB, when the non-scanning period comes, so as to charge a potential of the data signal line S to the charging potential PCV by means of the charging circuit 10.

The charging potential PCV in the non-scanning period is set to be a potential of the data signal line S in the scanning period constituting one frame in combination with the non-scanning period, that is, a substantially intermediate potential of the data signal. In the horizontal line inversion system, a positive potential and a negative potential are alternately applied to the pixels corresponding to the respective scanning signal lines G, so that the charging potential PCV in the non-scanning period is an intermediate value between the maximum value of the positive potential and the maximum value of the negative potential, that is, a potential VCOM of a counter electrode. Note that, due to parasitic capacitance etc. of the active element SW or the analog switch of the sampling circuit 14 of the data signal line driving circuit SD, the charging potential PCV is not exactly the intermediate value. Thus, this is referred as "substantially intermediate value" in this specification.

In the present invention, a potential of the data signal line S during the non-scanning period is charged to the substantially intermediate potential of the data signal in the scanning period at a corresponding frame by means of the charging circuit 10. Then, at least right before the next scanning period begins, the charging circuit 10 is high impedance so as to restore the data signal line S to be under the floating condition. Thus, in the liquid crystal display device 11, extremely large dispersion does not occur in the potential of the respective pixel capacitor Cp with respect to the potential of the data signal line S, so that it is possible to restrict dispersion of the leak current flowing via the active element. Thus, even though the non-scanning period is set to be sufficiently longer than the scanning period while the standby image etc. is being displayed, and the frame frequency is reduced so as to realize low power consumption, potential variation of the pixel PIX is reduced, so that it is possible to improve the display quality during the non-scanning period.

Further, as shown in FIG. 2, the control circuit CTL varies the control signals PCC and PCCB at each horizontal period before outputting the selective pulse to the scanning signal line G, and the potential of the data signal line S is preliminarily charged to the charging potential PCV by means of the charging circuit 10. The charging potential PCV in the scanning period is a predetermined positive potential when a positive potential is applied to the pixel corresponding to the scanning signal line G. The charging potential PCV in the scanning period is a predetermined negative potential when a negative potential is applied to the pixel corresponding to the scanning signal line G. The charging potential PCV is set to be an intermediate value between the maximum value and the minimum value in each polarity.

Thus, a potential of the data signal line S corresponding to the image signal DAT of a previous line is preliminarily charged to a potential predetermined by polarity of the image signal DAT of the next line before scanning with respect to the next line, so that the data signal line driving circuit SD can write the potential of a desired image signal DAT easily. Thus, it is possible to make current capacitor of the data signal line driving circuit SD smaller.

As described above, it is possible to realize the charging circuit 10 of the present invention by using a circuit which performs the preliminary charge with respect to the data signal line S, so that a conventional pre-charge circuit can be shared. In this case, the foregoing operation is realized only by reviewing sequence of the control signal generating circuit CTL, without increasing structures. While, although it is possible to realize the present invention by using the data signal line driving circuit SD, the charging circuit 10 has a simpler circuit structure compared with a complicated structure in which the data signal line driving circuit SD performs sampling with respect to the image signal DAT, so that it is possible to realize lower power consumption compared with a case of using the data signal line driving circuit SD.

Further, in the liquid crystal display device 11 of the present invention, each of the data signal line driving circuit SD, the scanning signal line driving circuit GD, and the active element SW is constituted of a polycrystalline silicon thin film transistor, and they are formed on the same substrate. Thus, it is easier to enlarge an area of the polycrystalline silicon thin film than that of a single-crystal silicon, so that it is possible to realize area-enlargement by using the polycrystalline silicon thin film transistor to form the circuit and the element and by performing monolithic formation so that they are formed on the same substrate.

Further, in the liquid crystal display device 11 of the present invention, the data signal line driving circuit SD, the scanning signal driving circuit GD, and the respective pixel circuits include active elements manufactured at a process temperature not more than 600° C. If the process temperature of the active element is set to be not more than 600° C., even though a typical glass substrate (glass substrate whose deformation point is not more than 600° C.) is used as the active element, warpage and bending that are brought about by a process performed at not less than the deformation point do not occur, so that it becomes easier to package the circuits, and it is possible to realize further area-enlargement.

Figure 3:
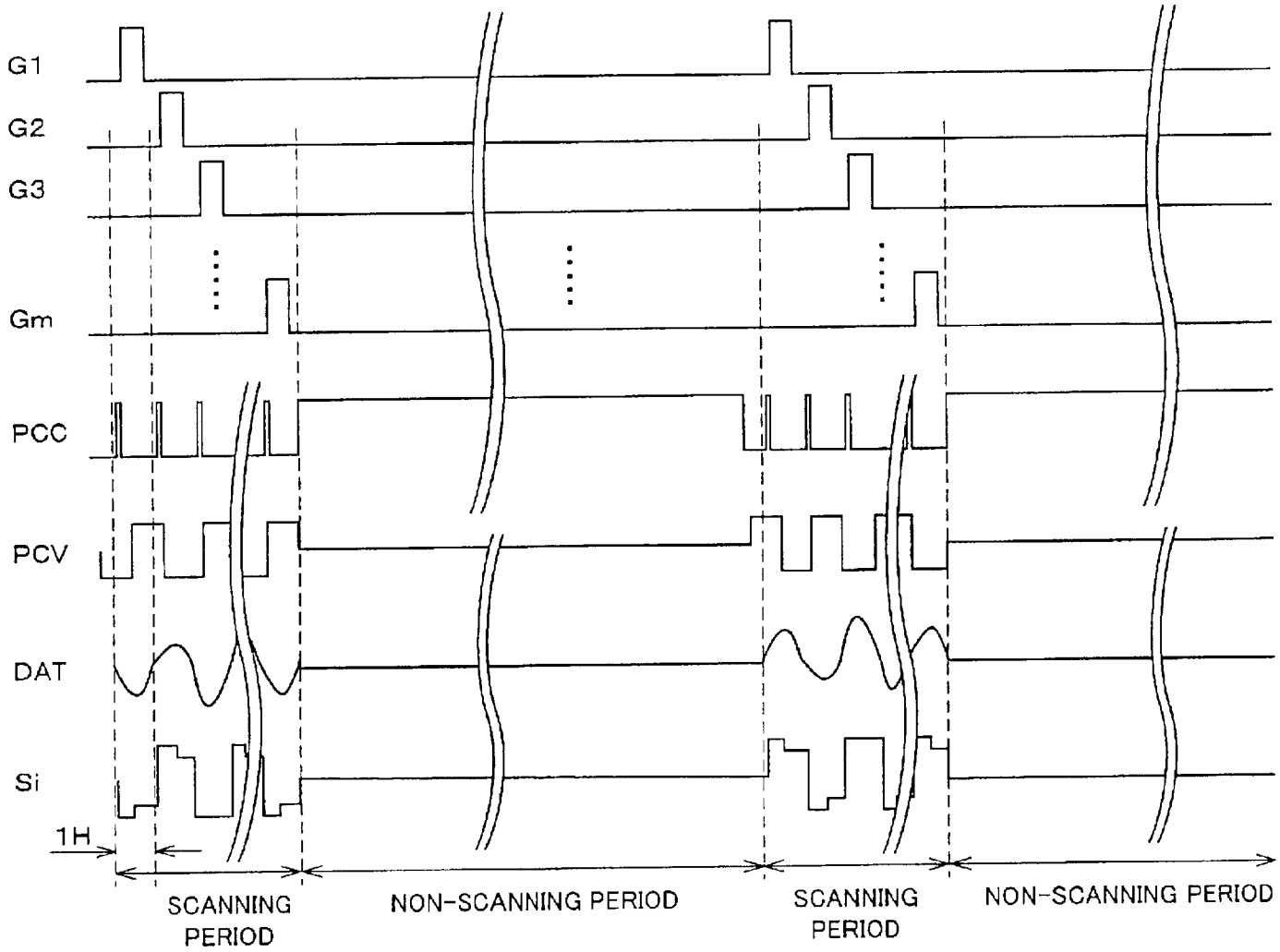
FIG. 3 is a wave form chart showing another example of the drive wave form of the liquid crystal display.

Note that, in the non-scanning period of the present invention, the data signal line S may be charged not only once but also plural times as shown by the control signal PCC of FIG. 2. Further, as shown by the control signal PCC of FIG. 3, the foregoing charging may be performed over substantially all the non-scanning period. As the charging period becomes larger, it is possible to stabilize the display quality better. Further, when the non-scanning period comes, the charging is started as early as possible, so that it is possible to obtain greater effect.

Further, also in accordance with dot inversion system, that is, vertical line inversion system, the data signal line S is charged to the substantially intermediate potential of the data signal during the scanning period at a corresponding frame in the same manner as in the aforementioned horizontal line inversion system, so that it is possible to apply the present invention. Further, also in the frame inversion system, the data signal line S is charged to the substantially intermediate potential between the maximum value and the minimum value of the data signal in the scanning period at a corresponding frame when the non-scanning period comes, so that it is possible to apply the present invention. However, in the horizontal line inversion system and the dot inversion system, positive data and negative data are evenly mixed at one frame. If there is no change in a dynamic range of the image signal DAT, the charging potentials PCV are substantially equalized to each other at all the frames, and it is possible to use the potential VCOM of the counter electrode for the charging potential PCV, so that it is possible to generate the charging potential PCV easily. On the other hand, in the frame inversion system, all the pixels PIX are charged so as to have the same polarity at one frame, so that polarity of the charging potential PCV varies to the substantially intermediate potential of positive polarity and to the substantially intermediate potential of negative polarity.

Further, even though the control signal generating circuit CTL is arranged so as to vary the charging potential PCV during the non-scanning period, it is possible to obtain the same effect. That is, in a case where the charging potential PCV is fixed at any potential as described above, unless the potential is set to be the substantially intermediate potential between the maximum value and the minimum value of the data signal in the scanning period at a corresponding frame, there may occur extremely large dispersion between the potential of the respective pixel PIX and the charging potential PCV of the data signal line S. On the other hand, the charging potential PCV during the non-scanning period varies so as to swing between the maximum value and the minimum value of the data signal in the scanning period at a corresponding frame, preferably the charging potential PCV swings in the vicinity of the intermediate potential, so that extremely large dispersion does not occur in the potential of the pixel PIX corresponding to the potential of the data signal line S. In this manner, it is possible to restrict the dispersion of the leak current flowing via the active element SW.

Another embodiment of the present invention is described as follows based on FIG. 4.

Figure 4:
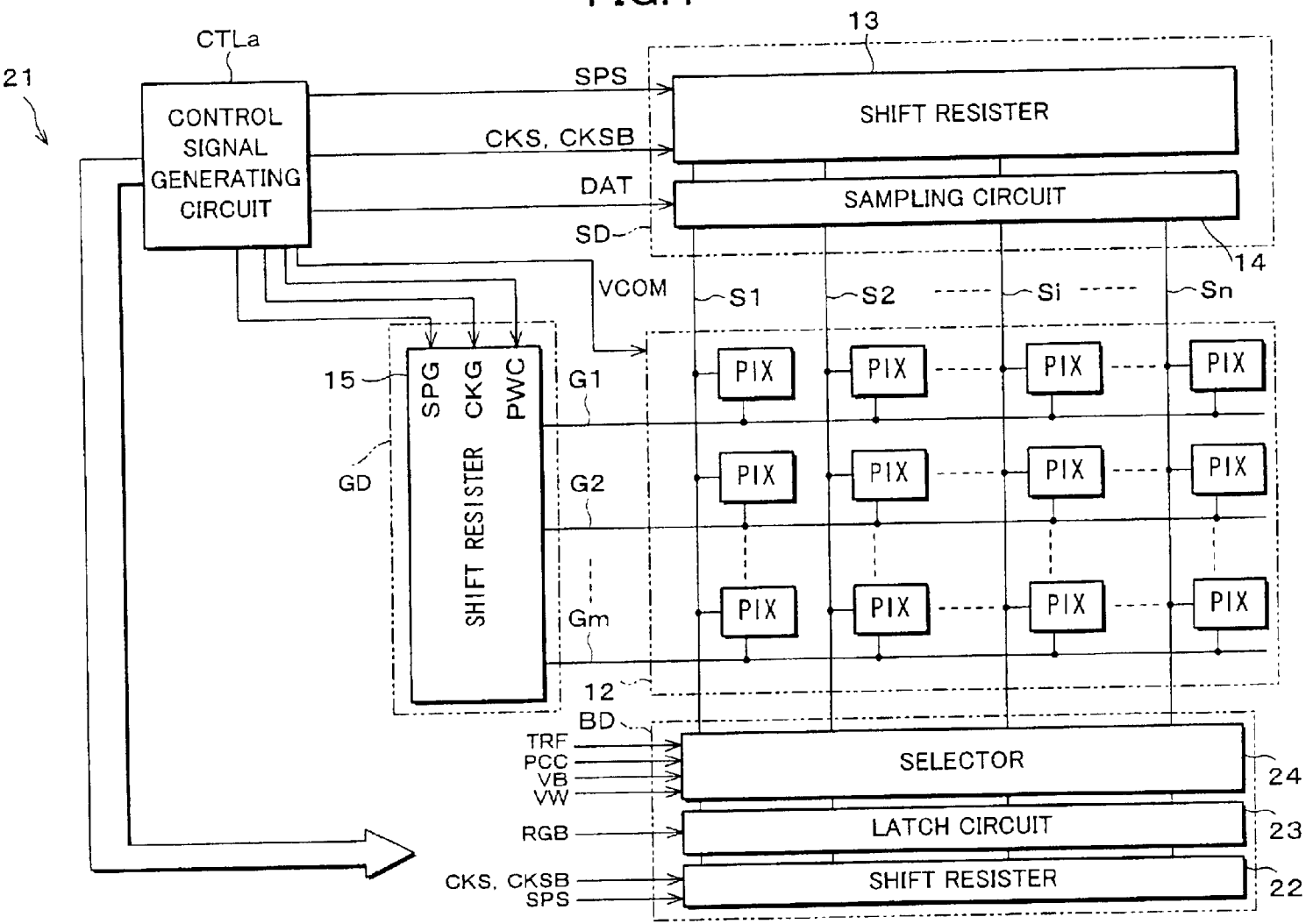
FIG. 4 is a block diagram showing an electric structure of a liquid crystal display device which is an image display device of another embodiment of the present invention.

FIG. 4 is a block diagram showing an electric structure of a liquid crystal display device 21 which is an image display device of another embodiment of the present invention. The liquid crystal display device 21 is similar to the liquid crystal display device 11. The same reference signs are given to corresponding portions, and description thereof is omitted.

It is noteworthy that, in the liquid crystal display device 21, a binary data signal line driving circuit BD is shared as charging means. That is, the data signal line driving circuit SD outputs a multi-gradation image signal DAT to the data signal line S, and the binary data signal line driving circuit BD outputs a two-gradation image signal RGB to the data signal line S. Although high display performance is required upon using the liquid crystal display device 21 like a display device of a cellular phone, the liquid crystal display device 21 is used to create a display with relatively low display level so that the minimum display is performed under a standby condition.

The binary data signal line driving circuit BD schematically includes: a shift resister 22; a latch circuit 23; and a selector 24. The shift resistor 22 is constituted of multistage flip flops, that are connected with each other in series, as in the shift resistor 3 of the data signal line driving circuit sd and the shift resister 13 of the data signal line driving circuit SD. When the clock signals CKS and CKSB, and the data scanning start signal SPS are inputted from a control signal generating circuit CTLa, the data scanning start signal SPS is outputted from a line between the flip flops adjacent to each other so as to be a latch pulse. In response to this, the latch circuit 23 sequentially latches binary image signals RGB for display that are inputted from the control signal generating circuit CTLa. The selector 24 selects any one of a liquid crystal applying voltage VB and a liquid crystal applying voltage VW both of which are inputted from the control signal generating circuit CTLa in response to the control signal TRF inputted from the control signal generating circuit CTLa, so as to output the selected liquid crystal applying voltage to the data signal lines S. The scanning signal lines G are accordingly selected, so that it is possible to realize two-gradation drive.

In the binary data signal line driving circuit BD arranged in the foregoing manner, the control signal PCC is inputted to the selector 24, and one liquid crystal applying voltage, for example, the liquid crystal applying voltage VW is outputted to the data signal lines S in a case of a normally white liquid crystal, so that it is possible to realize the same operation as in the charging circuit 10. Thus, the binary data signal driving circuit BD for realizing the low power consumption operation can also be used for the present invention without additionally providing a special circuit as potential holding means.

Note that, the sequence of the control signal TRF is changed and a reset signal is inputted to the latch circuit 23, it is possible to realize the same operation without using the control signal PCC. That is, when the latch circuit 23 is reset, the one liquid crystal applying voltage (VW) is selected. When the preliminary charging timing and the non-selecting period come, all the scanning signal lines G are made under a non-selecting scanning condition, and the liquid crystal applying voltage (VW) is outputted from the selector 24 in accordance with the control signal TRF.

Still another embodiment of the present invention is described as follows based on FIG. 5 and FIG. 6.

Figure 5:
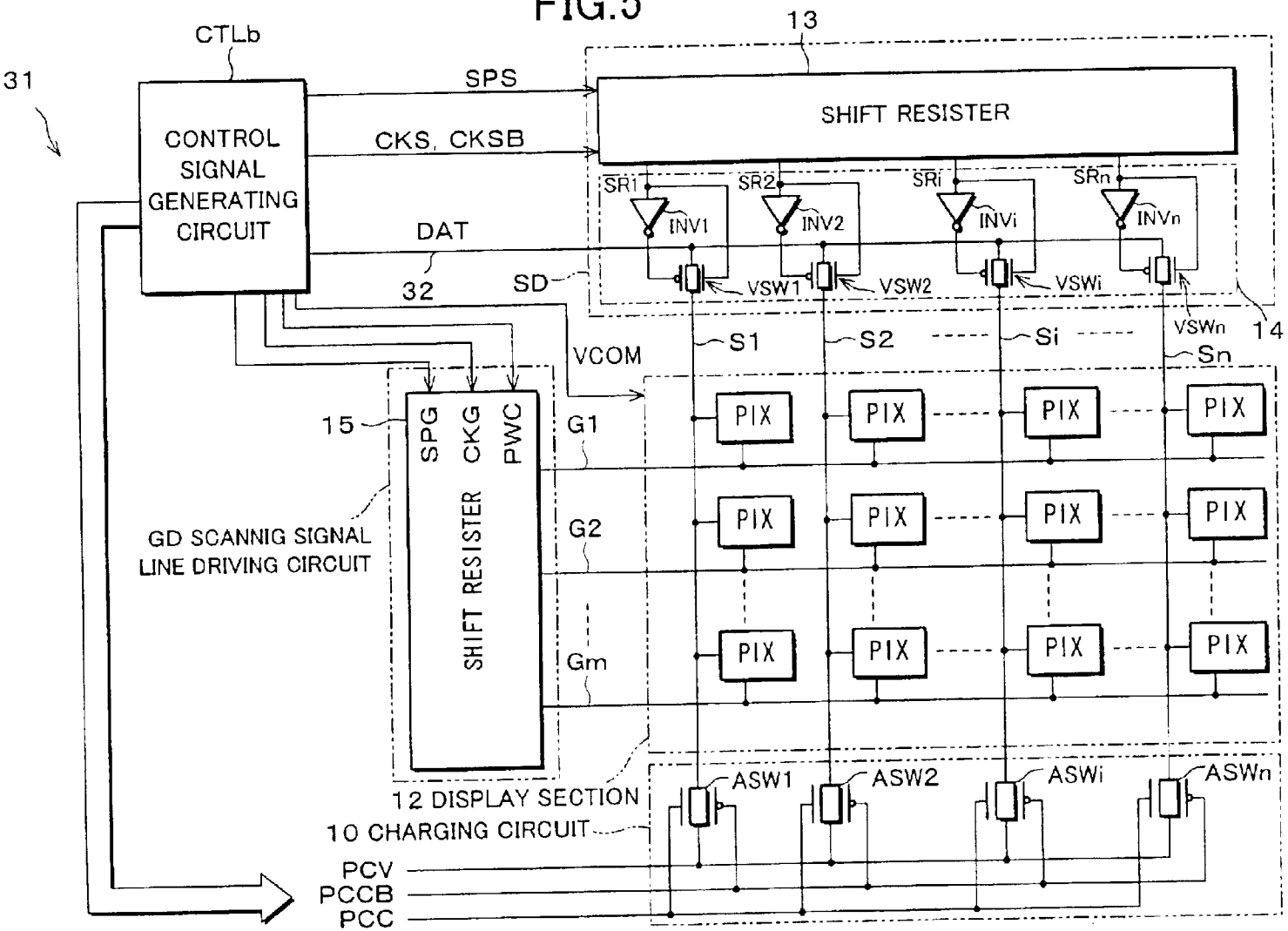
FIG. 5 is a block diagram showing an electric structure of a liquid crystal display device which is an image display device of still another embodiment of the present invention.

FIG. 5 is a block diagram showing an electric structure of a liquid crystal display device 31 which is an image display device of still another embodiment of the present invention. The liquid crystal display device 31 is similar to the liquid crystal display device 11, and the same reference signs are given to corresponding portions, and description thereof is omitted.

It is noteworthy that, in the liquid crystal display device 31, when the non-selecting period comes, a control signal generating circuit CTLb varies the control signals PCC and PCCB, the potential of the data signal line S is charged to the charging potential PCV by the charging circuit 10, and also the signal line 32 for outputting the image signal DAT from the control signal generating circuit CTLb to the sampling circuit 14 is charged to the charging potential PCV.

Figure 6:
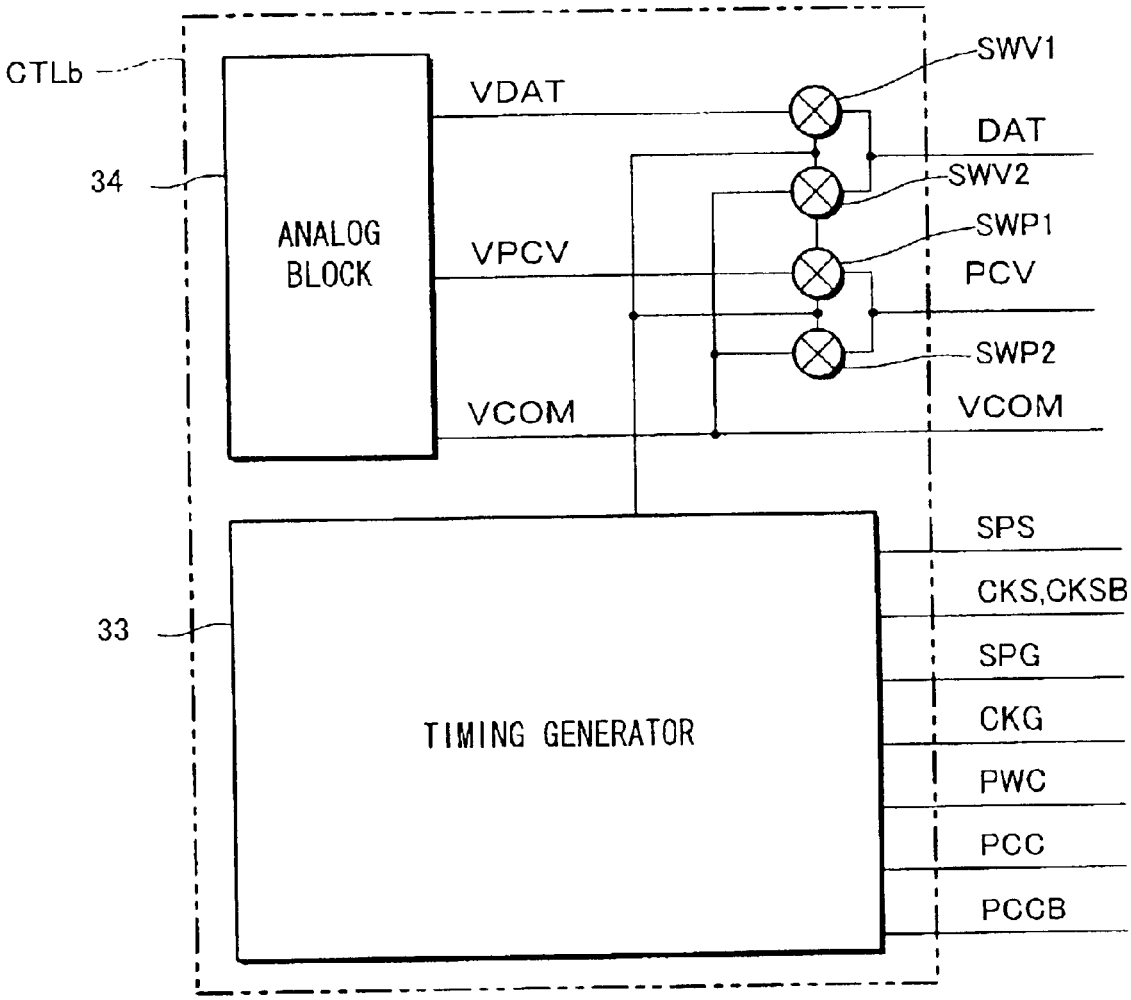
FIG. 6 is a diagram concretely showing an output portion of a charging potential in a control signal generating circuit shown in FIG. 5.

FIG. 6 is a diagram concretely showing an output portion of the charging potential PCV in the control signal generating circuit CTLb. The control signal generating circuit CTLb includes: a timing generator 33 constituted of a digital circuit; an analog block 34; analog switches SWV1 and SWV2, SWP1 and SWP2.

The timing generator 33 generates the signals CKS, CKSB, SPS, CKG, SPG, and PWC in response to an image signal from outside, and further generates the control signals PCC and PCCB. Corresponding to this, the analog block 34 generates an image signal VDAT and the charging potential VPCV, and further generates the potential VCOM of the counter electrode.

In the control signal generating circuit CTLb, the potential VCOM of the counter electrode is outputted directly to the counter electrode, so that the image signal VDAT and the charging potential VPCV are outputted via the analog switches SWV1 and SWP1. The analog switches SWV1 and SVW2 are connected to each other as one pair so as to share one output, and the analog switches SWP1 and SVP2 are connected to each other as one pair so as to share one output, and (a) the pair of the analog switches SWV1 and SWV2 and (b) the pair of the analog switches SWP1 and SWP2 are controlled so as to perform a reciprocity operation. The potential VCOM is inputted to the analog switches SWV2 and SWP2 so that they share the potential VCOM.

In response to the control signals PCC and PCCB, the timing generator 33 turns ON the analog switches SWV1 and SWP1 and turns OFF the analog switches SWV2 and SWP2, as the image signal DAT and the charging potential PCV, in the scanning period, so that the image signal VDAT and the charging potential VPCV are outputted respectively. Further, the analog switches SWV2 and SWP2 are turned ON in the non-selecting period and the analog switches SWV1 and SWP1 are turned OFF in the non-selecting period, so that the potential VCOM of the counter electrode is outputted via both the analog switches SWV2 and SWP2.

Referring to FIG. 5 again, FIG. 5 concretely shows the sampling circuit 14, and a sampling circuit 14 is constituted of the flip flops at the respective stages of the shift resistor 13, that is, inverters INV1 to INVn and analog switches VSW1 to VSWn corresponding to the data signal lines S1 to Sn respectively. As in the analog switches ASW1 to ASWn of the charging circuit 10, the analog switches VSW1 to VSWn are constituted of a pair of a p-type switching element and a t-type switching element so that the image signal DAT and the charging potential PCV both of which have positive and negative polarities can be outputted. Thus, the inverters IVN1 to INVn are provided, and sampling signals SR1 to SRn from the flip flops at the respective stages are applied to the pairs of switching elements of the analog switches VSW1 to VSWn directly and after being inverted at the inverters INV1 to INVn.

During the scanning period, in response to the clock signals CKS and CKSB, the data scanning start signal SPS is sequentially outputted as the sampling signals SR1 to SRn from the flip flops at the respective stages. Thus, the analog switches VSW1 to VSWn are sequentially turned ON, and the image signal DAT is outputted to the data signal line S, so as to be taken in the pixel capacitor Cp of each pixel PIX.

While, during the non-selecting period, the analog switches VSWL to VSWn are OFF, but the signal line 32 of the image signal DAT as well as the data signal line S are charged to the charging potential PCV (potential VCOM of the counter electrode), so that the source/drain voltages VDS are substantially equalized to each other, so that it is possible to restrict occurrence of leak currents in the analog switches VSW1 to VSWn. Thus, even though there is a difference between (a) the potential of the data signal line S which is set to be the charging potential PCV of the substantially intermediate potential and (b) the potential of the pixel capacitors Cp, a leak current flowing via the analog switches VSW1 to VSWn due to the difference is restricted, and potential variation of the pixel PIX is further reduced, so that it is possible to further improve the display quality in the non-scanning period.

Note that, in the foregoing description, the analog switches VSW1 to VSWn are OFF during the non-scanning period. However, if the potential of the signal line 32 of the image signal DAT is equalized to the potential of the data signal line S, a current flowing through the analog switches VSW1 to VSWn is 0, so that the analog switches VSW1 to VSWn may be ON.

Another embodiment of the present invention is described as follows based on FIG. 7.

Figure 7:
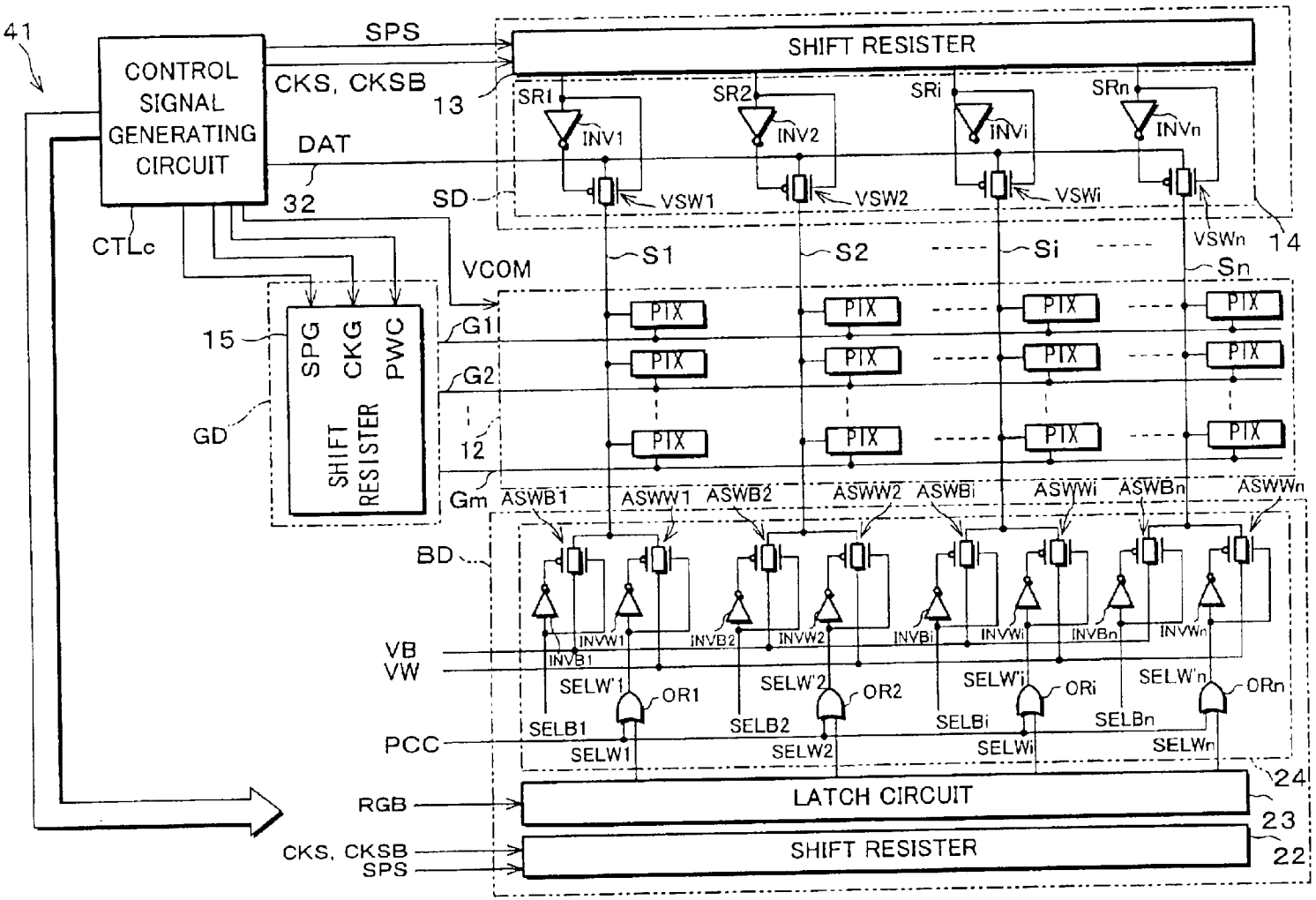
FIG. 7 is a block diagram showing an electric structure of a liquid crystal display device which is an image display device of another embodiment of the present invention.
Figure 8:
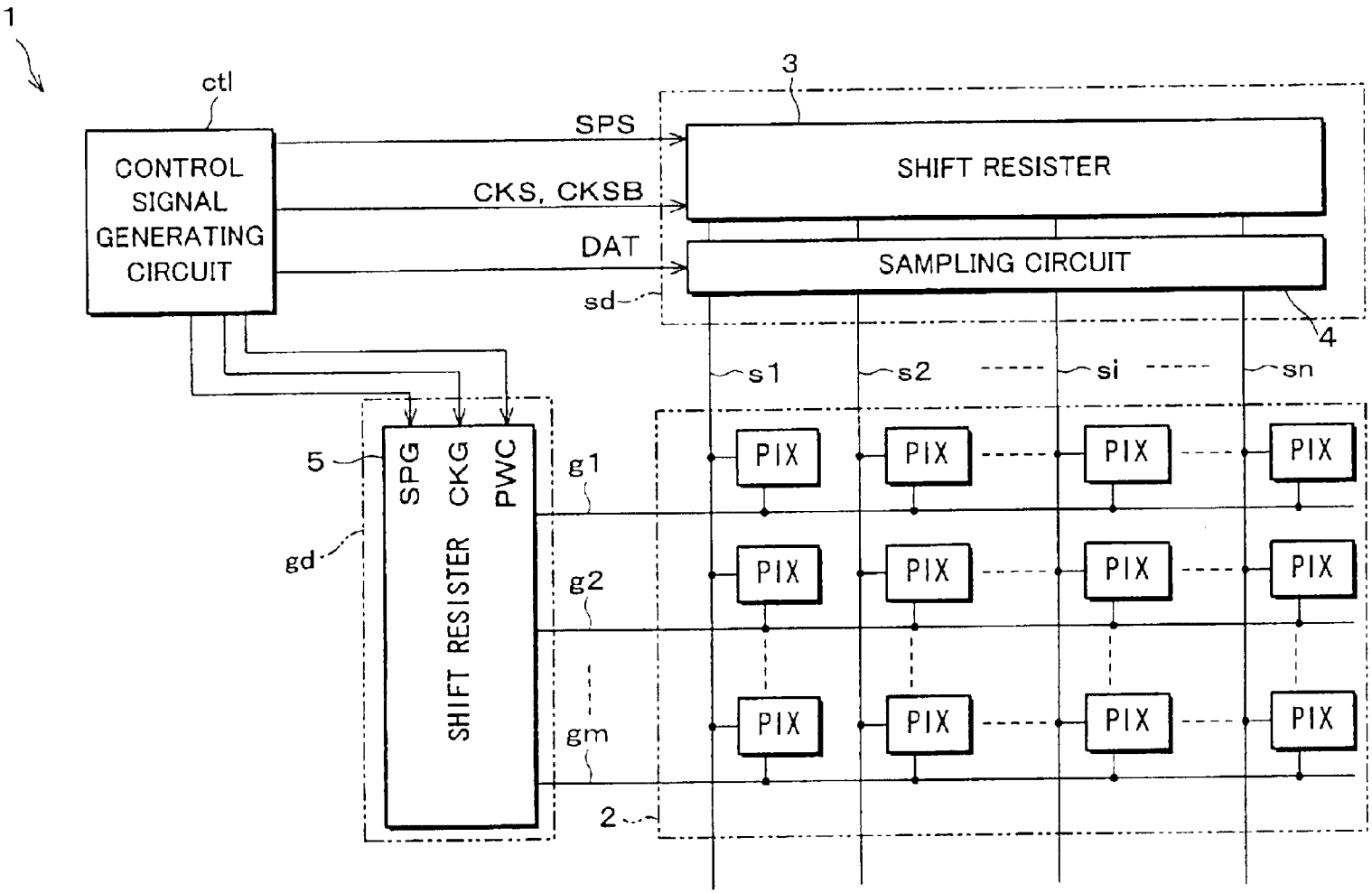
FIG. 8 is a block diagram showing an electric structure of a liquid crystal display device which is a typical image display device of active matrix system in prior art.
Figure 9:
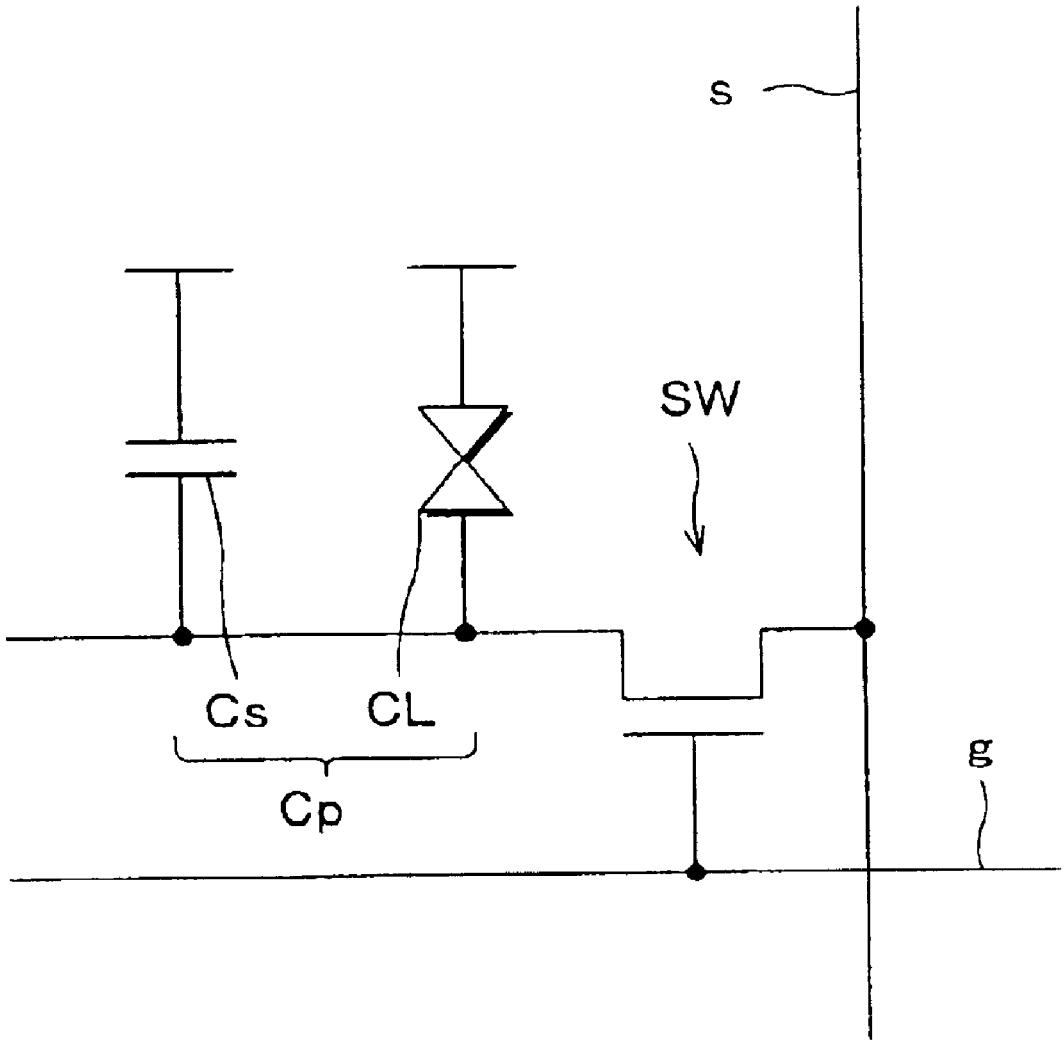
FIG. 9 is an equivalent circuit diagram of respective pixels of the liquid crystal display device.
Figure 10:
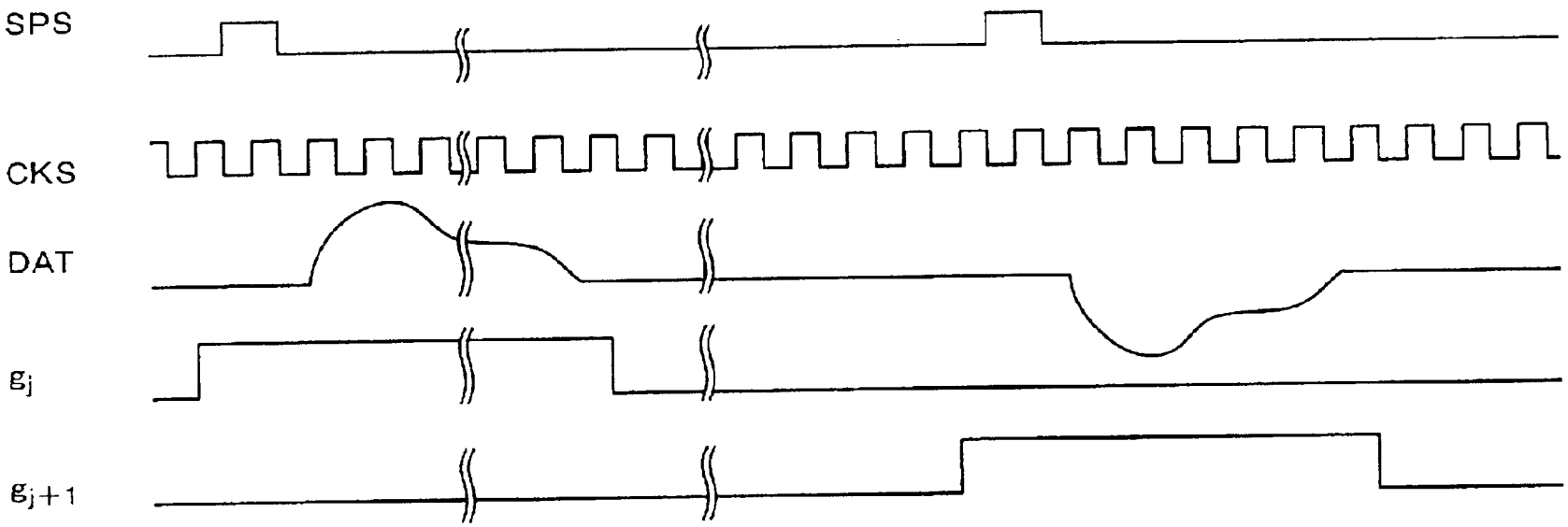
FIG. 10 is a wave form chart showing an example of a drive wave form for a writing operation of the liquid crystal display device shown in FIG. 8.
Figure 11:
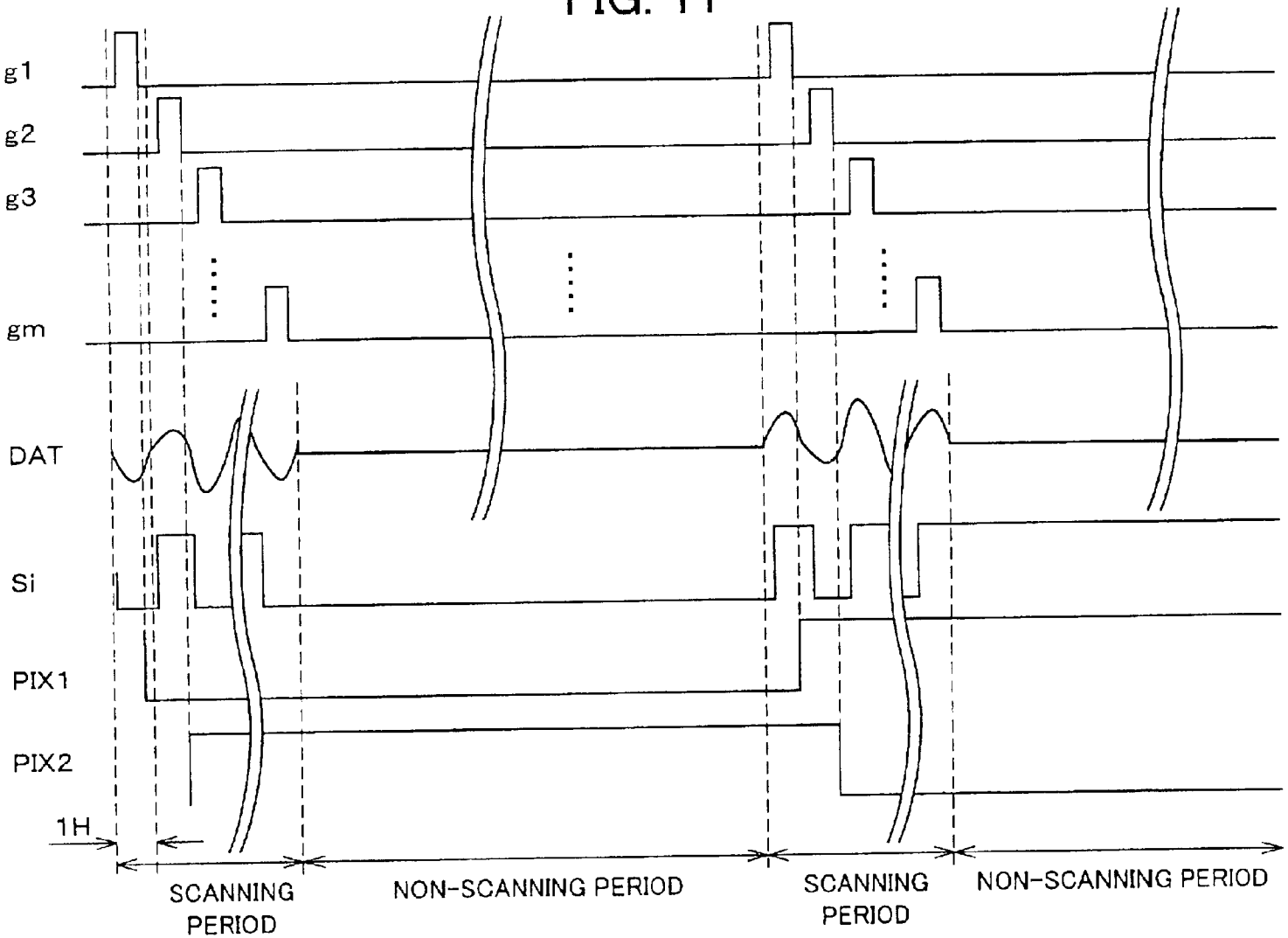
FIG. 11 is a wave form chart showing an example of a drive wave form of the conventional liquid crystal display device shown in FIG. 8.
Figure 12:
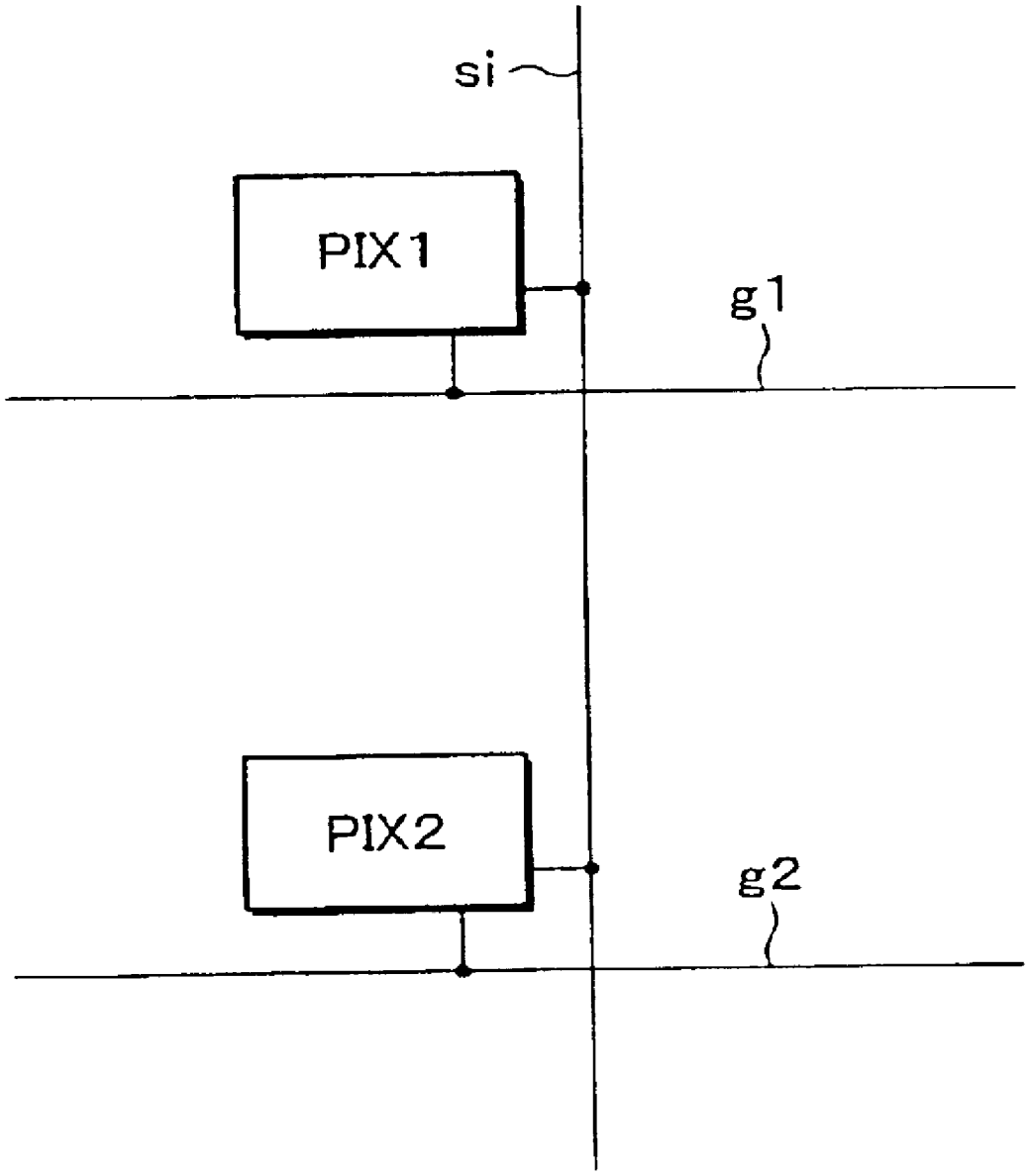
FIG. 12 is a diagram illustrating a sighted pixel.
Figure 13:
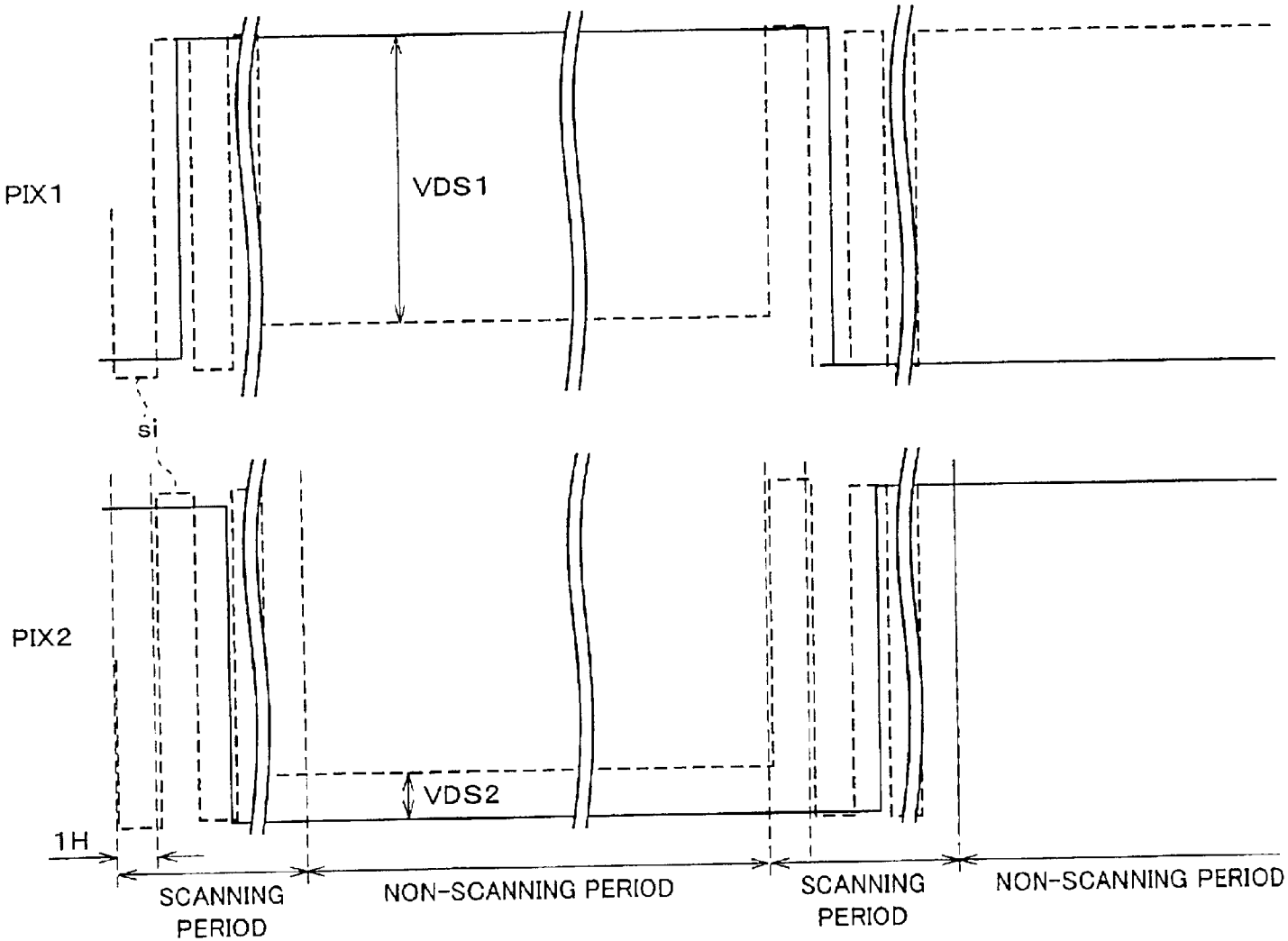
FIG. 13 is a wave form chart for illustrating an operation shown in FIG. 11.

FIG. 7 is a block diagram showing an electric structure of a liquid crystal display device 41 which is an image display device of another embodiment of the present invention. The liquid crystal display device 41 is similar to the aforementioned liquid crystal display devices 21 and 31. The same reference signs are given to corresponding portions, and description thereof is omitted. The liquid crystal display device 41 is different from the liquid crystal display device 21 of FIG. 4 in that a control signal generating circuit CTLc similar to the control signal generating circuit CTLb shown in FIG. 6 is used.

FIG. 7 concretely shows a selector 24, and the selector 24 corresponds to flip flops at the respective stages of the shift resistor 22, that is, the respective signal lines S1 to Sn, and includes: pairs of analog switches ASWB1 to ASWb and ASWW1 to ASWWn; inverters INVB1 to INVBn, INVW1 to INVWn for the analog switches ASWB1 to ASWb and ASWW1 to ASWWn; and OR gates OR1 to ORn. As in the analog switches ASW1 to ASWn and VSW1 to VSWn, the analog switches ASWB1 to ASWBn and ASWW1 to ASWWn are constituted of pairs of P-type and N-type switching elements.

The analog switches ASWB1 to ASWBn and the inverters INVB1 to INVBn corresponding thereto are provided so as to apply the liquid crystal applying voltage VB to the data signal lines S1 to Sn, and the analog switches ASWW1 to ASWWn and the inverters INVW1 to INVWn corresponding thereto are provided so as to apply the liquid crystal applying voltage VW to the data signal lines S1 to Sn. Further, any one of (a) the selective signals SELB1 to SELBn and (b) the selective signals SELW1 to SELWn both of which have been generated by a theory circuit (not shown) become active (high level) in accordance with the control signal TRF and the image signal RGB, so that any one of the liquid crystal applying voltage VB and the liquid crystal applying voltage VW is outputted via the analog switches ASWB1 to ASWBn or the analog switches ASWW1 to ASWWn to the data signal lines S1 to Sn.

Further, in the selector 24 of FIG. 7, in response to the control signal PCC, the liquid crystal applying voltage VW is outputted out of the liquid crystal applying voltages Vb and VW. Thus, the selective signals SELW1 to SELWn are inputted as the selective signals SELW'1 to SELW'n to the analog switches ASWW1 to ASWWn and the inverters INVW1 to INVWn via the OR gates OR1 to ORn. The control signal PCC is applied to the OR gates OR1 to ORn. Thus, when any one of (a) the selective signals SELW1 to SELWn and (b) the control signal PCC becomes active (high level), the selective signals SELW'1 to SELW'n also becomes active (high level), so that the liquid crystal applying voltage VW is applied to the data signal line S.

Furthermore, in a case where the control signal PCC is made to be active (high level) during the non-selecting period, the control signal generating circuit CTLc sets the signal line 32 of the image signal DAT to be the liquid crystal applying voltage VW, and sets the liquid crystal applying voltage VB to be the liquid crystal voltage VW. The liquid crystal applying voltage VW in this case is the potential VCOM of the counter electrode.

Thus, it is possible to restrict a leak current flowing via the analog switches ASWB1 to ASWBn that are OFF when the control signal PCC becomes active (high level).

Note that, in the foregoing description, the variation of the potential of the data signal line S is emphasized. However, pixels that perform display functions are separated from the data signal line S by the active elements SW, so that it is needless to say that the pixels performs conventional function and can operate without exerting any undesirable influence on the display.

It is possible to suitably carry out the present invention in another active-matrix-type image display device.

An image display device of the present invention includes an electro-optic element, and a corresponding pair of an active element and a pixel capacitor, which are provided at an area sectored by a plurality of scanning lines and a plurality of data signal lines intersecting with each other, and the electro-optic element is driven to create a display in accordance with an electric charge that has been taken in the pixel capacitor by means of the active element during a scanning period of the scanning signal line, wherein the image display device further includes charging means for charging the data signal line to a substantially intermediate potential of a data signal at a frame corresponding to a non-scanning period of the scanning signal line during the non-scanning period.

According to the arrangement, an active-matrix-type image display device is arranged so that: an active element is provided at an intersection of a plurality of scanning lines and a plurality of data signal lines intersecting with each other, and a data signal is taken in a pixel capacitor by means of the active element during a scanning period of the scanning signal line, and an electric charge of the data signal that has been taken in the pixel capacitor drives an electro-optic element to create a display, so that the display state is maintained also during a non-scanning period of the scanning signal line, wherein the charging means charges a potential of the data signal in the non-scanning period to a substantially intermediate potential of the data signal line during the scanning period at a corresponding frame. After completing the charge, at least right before the next scanning period begins, the charging means becomes high impedance, so that the data signal line is under the floating condition.

Thus, in a case where the potential of the data signal line in the non-scanning period is left at the maximum potential or the minimum potential of the data signal in the scanning period for example, an extremely large dispersion may occur between the potential of the data signal line and the potential of the pixel capacitors depending on the potential of the pixel capacitors. On the other hand, by setting the potential of the data signal line to be the substantially intermediate potential of the data signal, the extremely large dispersion does not occur between the potential of the pixel capacitors and the potential of the data signal line, so that it is possible to restrict dispersion of a leak current flowing via the active element. Thus, even though a frame frequency is decreased by setting the non-scanning period to be sufficiently longer than the scanning period while a standby image etc. is being displayed, so as to realize low power consumption, it is possible to reduce potential variation of the pixel, thus improving the display quality in the non-scanning period.

Further, the image display device of the present invention is arranged so that: an image signal source for supplying an image signal to a driving circuit of the data signal line outputs a charging potential to an image signal line, that extends from the data signal line to a driving circuit, and charges the image signal line to the substantially intermediate potential during the non-scanning period of the scanning signal line.

According to the arrangement, during the non-scanning period of the scanning signal line, the charging potential, set to be the substantially intermediate potential, that is sent from the image signal source for supplying the image signal, is applied to the charging means that charges the potential of the data signal line to the substantially intermediate potential of the data signal during the scanning period of corresponding frame. Then, the image signal source charges also the image signal line, that provides the image signal to a driving circuit of data signal line, to the substantially intermediate potential during the non-scanning period of the scanning signal line.

Thus, even though there occurs leak in the active element for outputting the data signal to the data signal line in the driving circuit of the data signal line, the potential of the data signal line and the potential of the image signal line are equalized to each other at the substantially intermediate potential, so that it is possible to restrict occurrence of a leak current. Thus, even though there is a difference between the potential of the data signal line set to be the substantially intermediate potential and the potential of the pixel capacitors, the occurrence of the leak caused by the difference is restricted, and the potential variation of the pixel is further reduced, so that it is possible to improve the display quality in the non-selecting period.

Furthermore, the image display device of the present invention is characterized in that: the driving circuit of the data signal line performs line inversion drive or dot inversion drive, and the substantially intermediate potential is a potential of a counter electrode.

According to the arrangement, when the ac drive is performed so as to prevent deterioration of the liquid crystal, all the pixels have the same polarity in the frame inversion drive, so that the substantially intermediate potential is an arbitrary potential. However, adjacent lines or adjacent dots have polarities different from each other in the line inversion drive or the dot inversion drive, so that the substantially intermediate potential is the potential of the counter electrode.

Thus, in the line inversion drive or the dot inversion drive, the potential of the counter electrode is used as the substantially intermediate potential, so that it is possible to readily generate the substantially intermediate potential.

Further, the image display device of the present invention includes an electro-optic element, and a corresponding pair of an active element and a pixel capacitor, which are provided at an area sectored by a plurality of scanning lines and a plurality of data signal lines intersecting with each other, and the electro-optic element is driven to create a display in accordance with an electric charge that has been taken in the pixel capacitor by means of the active element during a scanning period of the scanning signal line, wherein the image display device further includes potential varying means for varying a potential of the data signal line in the scanning period of the scanning signal line.

According to the arrangement, an active-matrix-type image display device is arranged so that: an active element is provided at an intersection of a plurality of scanning lines and a plurality of data signal lines intersecting with each other, and a data signal is taken in a pixel capacitor by means of the active element during a scanning period of the scanning signal line, and an electric charge of the data signal that has been taken in the pixel capacitor drives an electro-optic element to create a display, so that the display is maintained also during a non-scanning period of the scanning signal line, wherein the potential varying means varies a potential of the data signal, that is under a floating condition after an output from a data signal line driving circuit has become high impedance in the non-scanning period. At least right before the next scanning period begins, the potential varying means becomes high impedance, so that the data signal line is under the floating condition.

Thus, in a case where the potential of the data signal line is fixed for example, an extremely large dispersion may occur between the potential of the data signal line and the potential of the pixel capacitors depending on the potential of the pixel capacitors. On the other hand, the potential of the data signal line is varied, preferably a periphery of an intermediate potential is swept, so that the extremely large dispersion does not occur between the potential of the data signal line and the potential of the pixel capacitors, and it is possible to restrict the dispersion of a leak current flowing via the active element. Thus, even though a frame frequency is decreased by setting the non-scanning period to be sufficiently longer than the scanning period while a standby image etc. is being displayed, so as to realize low power consumption, it is possible to reduce potential variation of the pixel, thus improving the display quality in the non-scanning period.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image display device comprising an electro-optic element, and a corresponding pair of an active element and a pixel capacitor, which are provided at an area sectored by a plurality of scanning lines and a plurality of data signal lines intersecting with each other, said electro-optic element being driven to create a display in accordance with an electric charge that has been taken in the pixel capacitor by means of the active element during a scanning period of the scanning signal line, wherein said image display device further includes charging section for charging the data signal line to a substantially intermediate potential of a data signal at a frame corresponding to a non-scanning period of the scanning signal line during the non-scanning period.

2. The image display device as set forth in claim 1, further comprising a multi valued data signal line driving circuit for outputting a multi-gradation image signal and a binary data signal line driving circuit for outputting a two-gradation image signal, as a data signal line driving circuit for outputting an image signal to the data signal line, wherein the binary data signal line driving circuit is used also as the charging section.

3. The image display device as set forth in claim 1, wherein an image signal source for supplying an image signal to a driving circuit of the data signal line outputs a charging potential to an image signal line, that provides the image signal to a driving circuit of the data signal line, and charges the image signal line to the substantially intermediate potential during the non-scanning period of the scanning signal line.

4. The image display device as set forth in claim 1, wherein a driving circuit of the data signal line performs line inversion drive or dot inversion drive, and the substantially intermediate potential is a potential of a counter electrode.

5. An image display device comprising an electro-optic element, and a corresponding pair of an active element and a pixel capacitor, which are provided at an area sectored by a plurality of scanning lines and a plurality of data signal lines intersecting with each other, said electro-optic element being driven to create a display in accordance with an electric charge that has been taken in the pixel capacitor by means of the active element during a scanning period of the scanning signal line, wherein said image display device includes potential varying section for varying a potential of the data signal line during a non-scanning period of the scanning signal line.

6. A display driving method of an image display device which includes an electro-optic element, and a corresponding pair of an active element and a pixel capacitor, which are provided at an area sectored by a plurality of scanning lines and a plurality of data signal lines intersecting with each other, said electro-optic element being driven to create a display in accordance with an electric charge that has been taken in the pixel capacitor by means of the active element during a scanning period of the scanning signal line, the method comprising the step of charging a data signal line to a substantially intermediate potential of a data signal at a frame corresponding to a non-scanning period of the scanning signal line during the non-scanning period.

7. The method as set forth in claim 6, further comprising the step of charging an image signal line, that outputs an image signal from an image signal source to a driving circuit of the data signal line, to the substantially intermediate potential.

8. The method as set forth in claim 6, further comprising the step of causing a driving circuit of the data signal line to perform line inversion drive or dot inversion drive, wherein said substantially intermediate potential is a potential of a counter electrode.

9. A display driving method of an image display device which includes an electro-optic element, and a corresponding pair of an active element and a pixel capacitor, which are provided at an area sectored by a plurality of scanning lines and a plurality of data signal lines intersecting with each other, said electro-optic element being driven to create a display in accordance with an electric charge that has been taken in the pixel capacitor by means of the active element during a scanning period of the scanning signal line, said image display device comprising the step of varying a potential of the data signal line during a non-scanning period of the scanning signal line.

* * * * *